US007491070B2

(12) United States Patent
Chen et al.

(10) Patent No.: US 7,491,070 B2
(45) Date of Patent: Feb. 17, 2009

(54) FIXING STRUCTURE

(75) Inventors: Hsiao-Liang Chen, Banciao (TW); Hsin-Shen Chen, Jhonghe (TW)

(73) Assignee: Micro-Star Int'l Co., Ltd., Jung-He (TW)

( * ) Notice: Subject to any disclaimer, the term of this patent is extended or adjusted under 35 U.S.C. 154(b) by 3 days.

(21) Appl. No.: 11/534,840

(22) Filed: Sep. 25, 2006

(65) Prior Publication Data

US 2008/0076278 A1 Mar. 27, 2008

(51) Int. Cl.
*H01R 4/66* (2006.01)

(52) U.S. Cl. ..... 439/92; 439/95; 361/804

(58) Field of Classification Search ..... 439/92, 439/95, 108, 876; 361/804, 807
See application file for complete search history.

(56) References Cited

U.S. PATENT DOCUMENTS 6,017,226 A * 1/2000 Jeffries et al. ..... 439/92
6,155,846 A * 12/2000 Yeoh et al. ..... 439/95
2002/0098726 A1* 7/2002 Deguchi ..... 439/92
2002/0142632 A1* 10/2002 Moore ..... 439/95
2005/0079748 A1* 4/2005 Kim ..... 439/92
2005/0266707 A1* 12/2005 Franks, Jr. ..... 439/92
2005/0277314 A1* 12/2005 Inoue ..... 439/92
2007/0141870 A1* 6/2007 Chen et al. ..... 439/92

* cited by examiner

*Primary Examiner*—Hien Vu
(74) *Attorney, Agent, or Firm*—Workman Nydegger

(57) ABSTRACT

A fixing structure including a fixing part, an elastic member disposed on the fixing part, a first element disposed on the fixing part by the elastic member, and a second element connected to the first element is provided. When the first element and the second element are not in a same height level, one may force the first element to be adjusted within the elastic deformation range of the elastic member until the first element is in the same height level with the second element, such that the first element and the second element are connected and fixed together.

2 Claims, 14 Drawing Sheets

FIXING STRUCTURE

BACKGROUND OF THE INVENTION

1. Field of Invention

The present invention relates to a fixing structure, and more particularly, to a fixing structure for adjusting two elements to be in a same height level and connected with each other.

2. Related Art

With the rapid development of science and technology and information, computer devices have become essential products in work and daily life. For example, computers, such as notebook computers and desktop computers have become more and more popular, even server/work stations have been increasingly used in business by companies. Current commercial-available computer periphery hardware devices, such as various interface cards, removable hard disk drives with hot plugging can function only when being electrically connected to the mother board. Therefore, how to quickly and conveniently install the hardware devices has become an essential problem to be solved.

FIG. 1A and FIG. 1B show a positioning structure 10 of the conventional computer device. A plurality of copper pillars 12 is screwed on the case 11 of the computer device to serve as fixing elements. The motherboard 20 and the case 11 are spaced by a certain distance. A screw 13 passes through the motherboard 20 and is locked to the copper pillars 12. The motherboard 20 is suspended by the copper pillars 12, so as to avoid the short circuit caused by solder joints at the back of the motherboard 20 directly contacting the case 11.

The motherboard 20 in the prior art is suspended and fixed by the positioning structure 10, and conventionally the positioning structure 10 fastens the motherboard 20 on the copper pillars 12 with screws 13, such that the motherboard 20 cannot shift. If a hardware device 30 is externally connected as required, the height of the hardware device 30 must be associated with that of the motherboard 20 so as to electrically connect the connecting port 31 of the hardware device 30 to a connector 21 of the motherboard 20. Since there are various kinds of hardware devices commercial-available such as image displaying cards, sound cards, and removable hard disk drives, the specification and size of hardware devices manufactured by various manufacturers are slightly different, and the position of the connecting port 31 is also different. When the hardware devices 30 are replaced by a user, a hardware device 30 manufactured by different manufacturers used for replacing the former one is difficult or hardly connected to the motherboard 20, thus limiting the replacement of the hardware device 30 and causing an inconvenient to the user. If the external connected hardware device 30 is forced to be inserted in the connector 21 of the motherboard 20, a possible damage may be caused to the connector 21 of the motherboard 20 or the connecting port 31 of the hardware device 30.

If the connector 21 of the motherboard 20 is adjusted to match the connecting port 31 of the hardware device 30 not in the same height level with the connector 21, the positioning structure 10 for fixing the motherboard 20 must be removed and then the connector 21 is adjusted to the same height as the connecting port 31 of the periphery hardware device 30, so as to be electrically connected to the connecting port 31 and then lock the motherboard 20 to the copper pillar 12. As a result, the process for replacing the hardware device 30 is relatively time and labor consuming, and thus does not conform to the high speed and efficiency requirements of the current industrial and commercial society. In addition, due to the tolerance generated during the manufacturing process of the motherboard 20, the procedure for connecting the periphery hardware device 30 to the motherboard 20 fixed in different height level is a challenge.

Therefor, because the positioning structure in the prior art cannot adjust the connection position of elements, the difference size and specification and tolerance between two elements results in that the interconnection is difficult.

SUMMARY OF THE INVENTION

In view of the above, it is an object of the present invention to provide a fixing structure to eliminate the limitation or defect existing in the prior art that the position of two elements cannot be adjusted, such that two elements cannot be connected due to different tolerances and specifications.

The present invention provides a fixing structure, which comprises a fixing part, an elastic member, a first element, and a second element, wherein the first element is disposed on the fixing part by the elastic member, and the second element is moved towards the first element. When the first element and the second element are not in a same height level, one may force the first element to be adjusted within the deformation range of the elastic member until the first element is in the same height level with the second element, such that the first element and the second element are connected and fixed together.

The elastic member described in the present invention can be a blade spring, a spring, or a rubber washer, which all have the property of recovery after compression to provide a deformation rage for fine-tuning the position of the first element, thereby successively connecting the first element with the second element. Furthermore, the fixing part can be a pillar or a screw hole combined with a bolt passing through the first element, so as to press the first element against the elastic member.

The features and practice of the present invention are described below in details in the preferred embodiments with the accompanying figures.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

The fixing structure disclosed in the present invention can be applied to the electronic devices, such as desktop computers, notebook computers, and server host computers. In the detailed description of the present invention, the combination and electrical connection between the motherboard and the removable hard disk drive are taken as the preferred embodiment of the present invention. The accompanying drawings are reference for illustration, which will not limit the present invention.

Figure 1A:
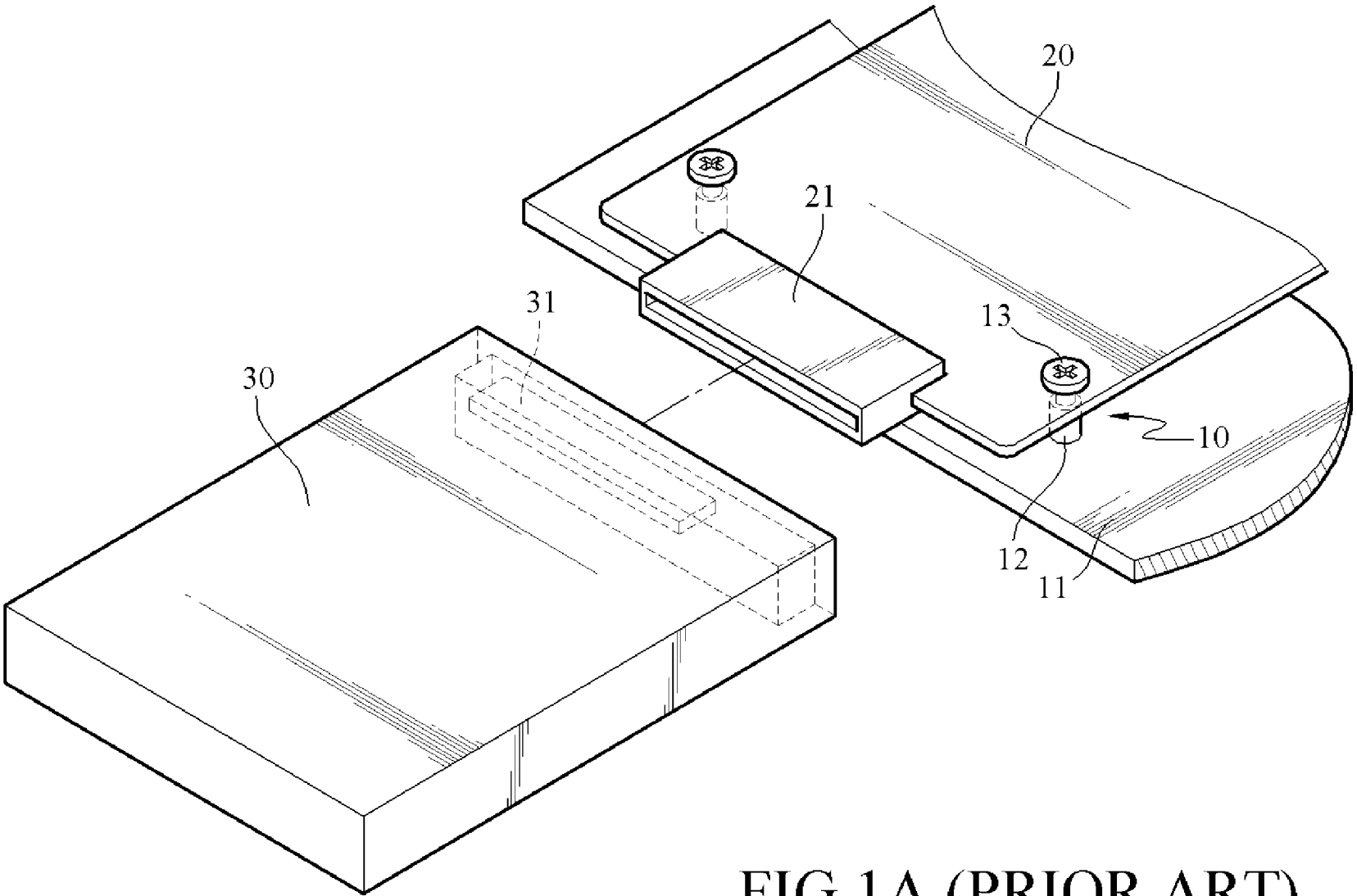
FIG.1A (PRIOR ART)
FIG. 1A is a schematic of a conventional positioning structure.
Figure 1B:
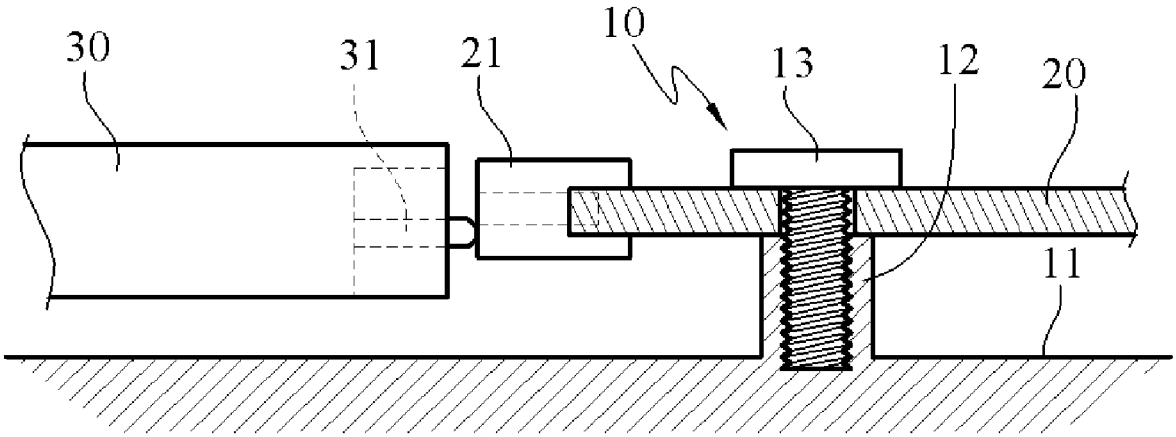
FIG.1B (PRIOR ART)
FIG. 1B is a schematic plan view of the conventional positioning structure.
Figure 2A:
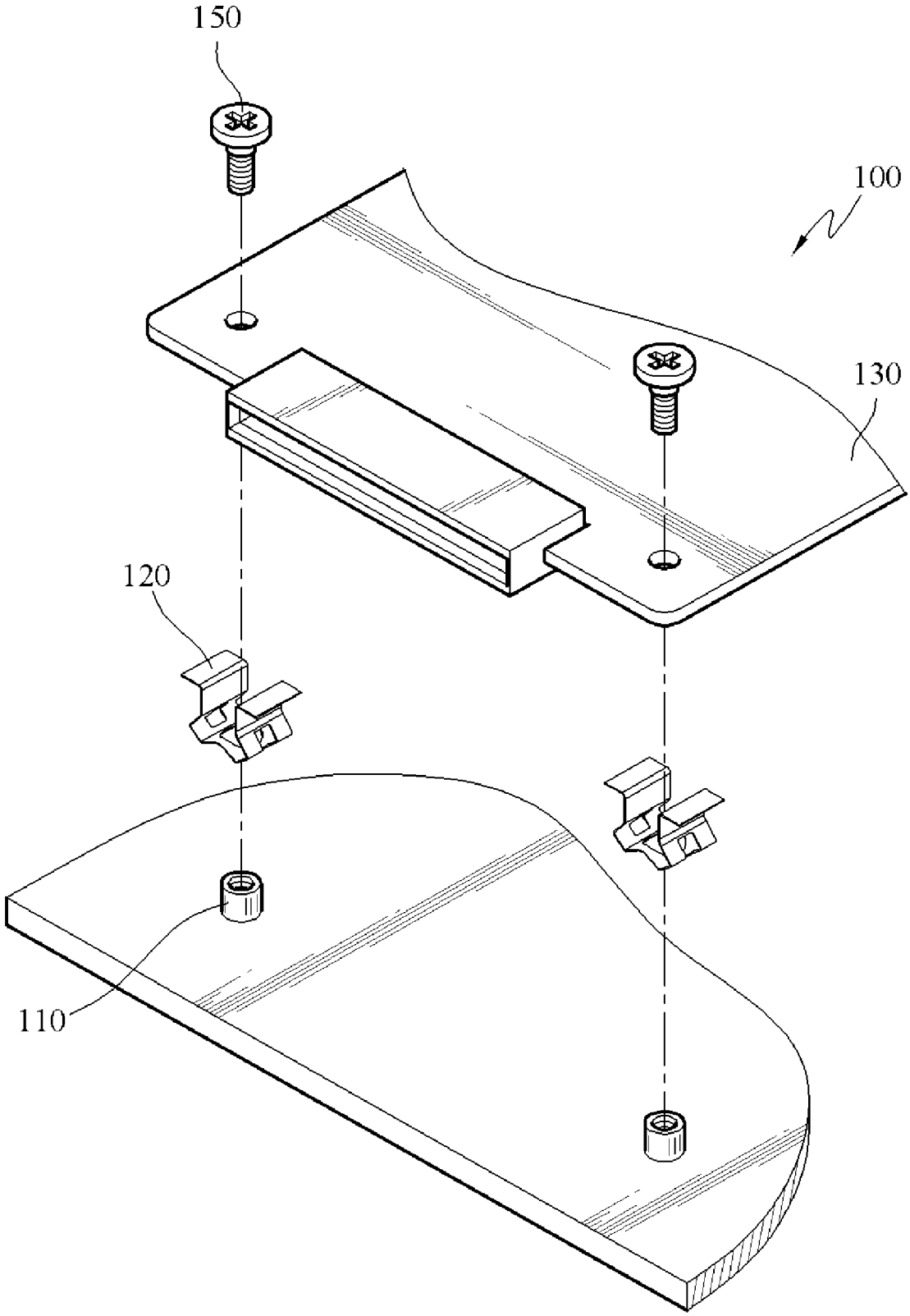
FIG. 2A is an exploded schematic view of a first embodiment of the present invention.
Figure 2B:
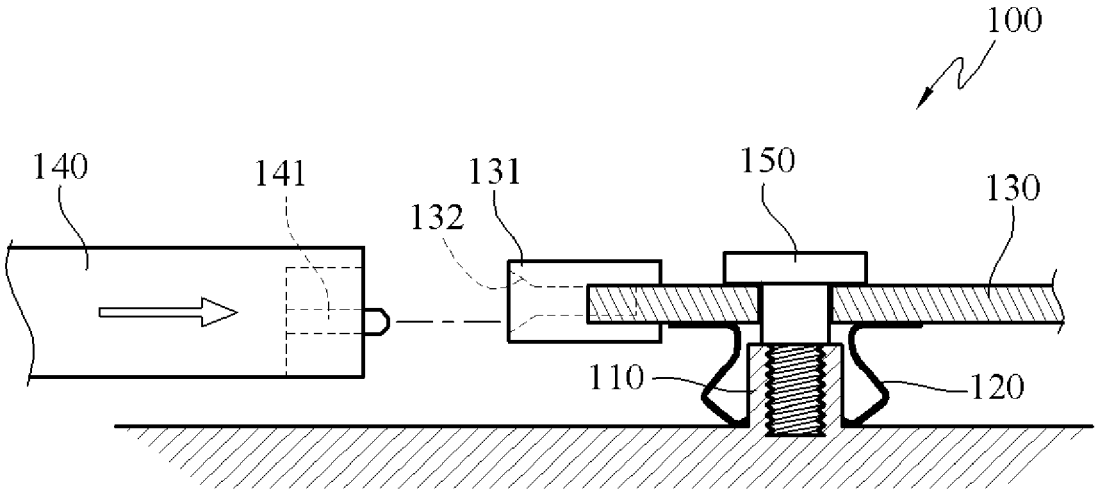
FIG. 2B is a schematic plan view of the two elements not being connected according to the first embodiment of the present invention.
Figure 2C:
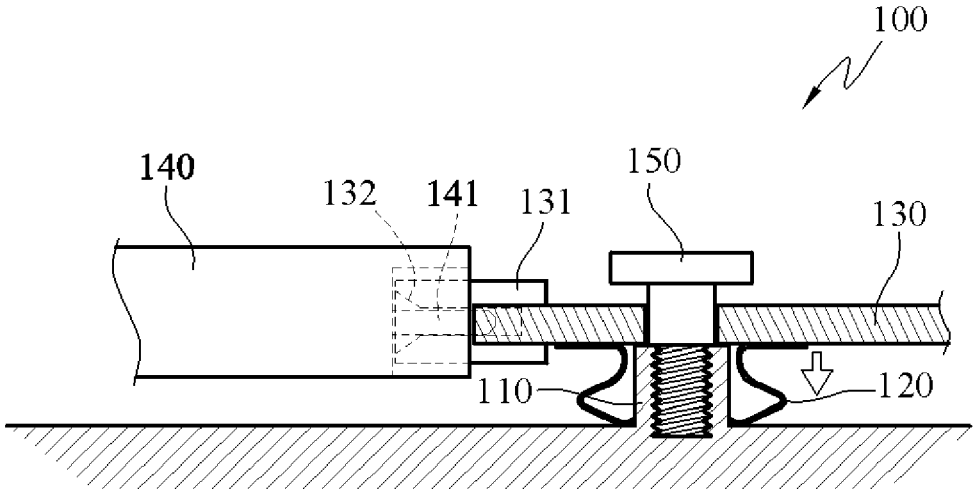
FIG. 2C is a schematic plan view of the two elements connected together according to the first embodiment of the present invention.

As shown in FIGS. 2A to 2C, the first element of the present invention can be a motherboard 130 in practice, which has a connector 131 electrically connected to the motherboard 130 to function as a connection interface for the motherboard 130. The second element can be a removable hard disk drive with the function of hot plugging in practice, which has an electrical connection end 141 being electrically connected to the connector 131 of the motherboard 130. In FIGS. 2A to 2C, a fixing structure 100 of the first embodiment of the present invention comprises a fixing part, an elastic member disposed on the fixing part, a motherboard 130 disposed on the fixing part by the elastic member; and a removable hard disk drive 140 connected to the motherboard 130, wherein the fixing part in the first embodiment is a pillar 110, and the elastic member is a blade spring 120.

As shown in FIGS. 2B to 2C, a method of connecting the two elements comprises disposing the motherboard 130 on a fixing part by an elastic member and moving the removable hard disk drive 140 towards the motherboard 130. When the motherboard 130 and the removable hard disk drive 140 are not in a same height level, one can forces the motherboard 130 to be adjusted within the deformation range of the elastic member until being in the same height level with the removable hard disc 140, such that the connector 131 of the motherboard 130 and the electrical connection end 141 of the removable hard disk drive 140 are connected and fixed together. The motherboard 130 and the removable hard disk drive 140 are supported by the elastic member, and suspended above the reference surface, such as the surface of case, for a certain distance. The structure of the connector 131 further comprises a slot 132 for guiding the electrical connection end 141 of the removable hard disk drive 140 to smoothly slide into the connector 131. Taking the position of the removable hard disk drive 140 as the reference, the motherboard 130 is adjusted within the displacement range to be in a same height level with the removable hard disk drive 140, thereby the two elements are connected and fixed together.

A difference exists between the heights of an end surface of the blade spring 120 contacting the motherboard 130 and an end surface of the pillar 110 relative to the motherboard 130, thus providing a maximum elastic displacement range for the motherboard 130, such that the pillar 110 can restrict the displacement range of the motherboard 130.

Figure 2D:
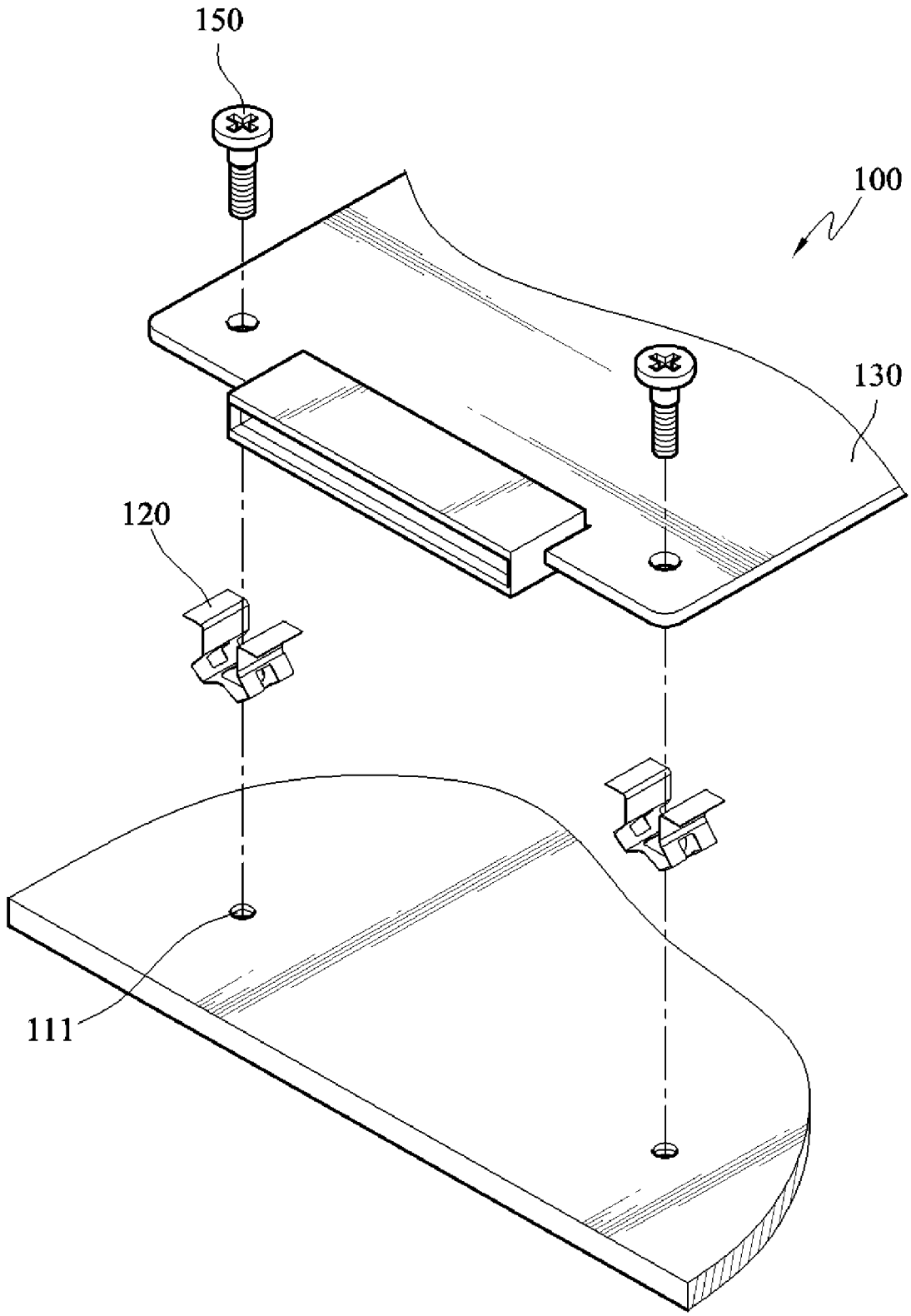
FIG. 2D is an exploded schematic view of a second embodiment of the present invention.
Figure 2E:
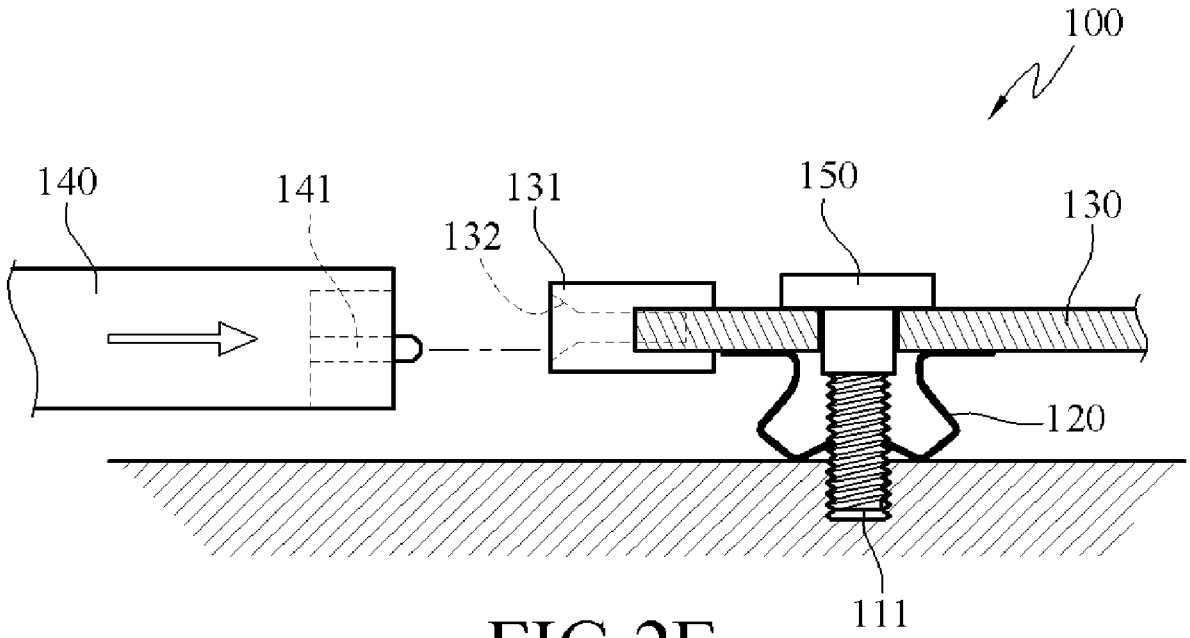
FIG. 2E is a schematic plan view of two elements not being connected according to the second embodiment of the present invention.
Figure 2F:
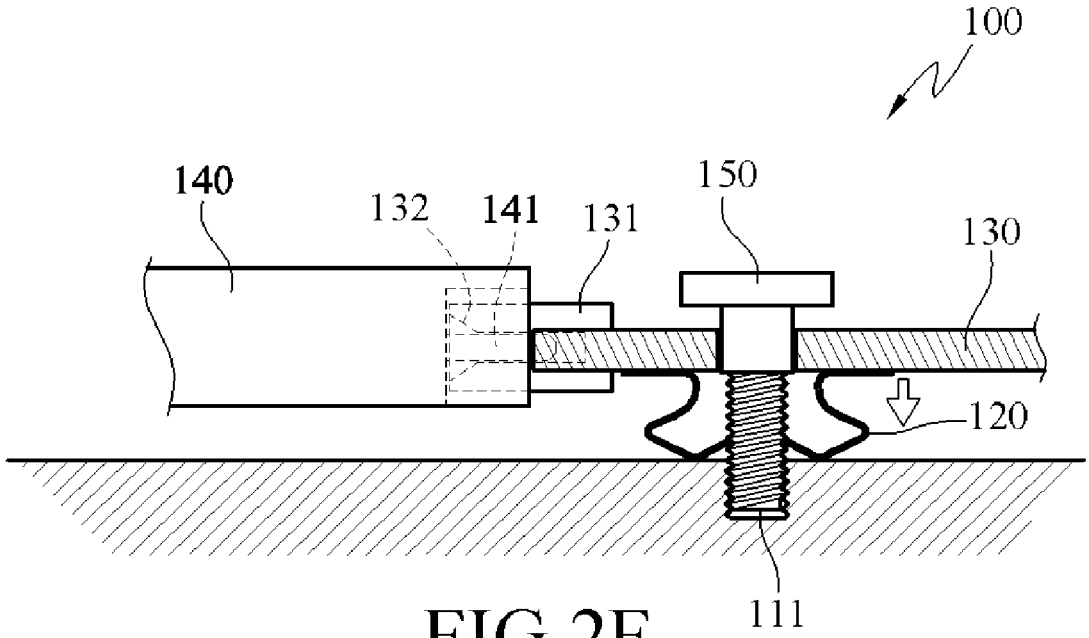
FIG. 2F is a schematic plan view of the two elements connected together according to the second embodiment of the present invention.
Figure 3A:
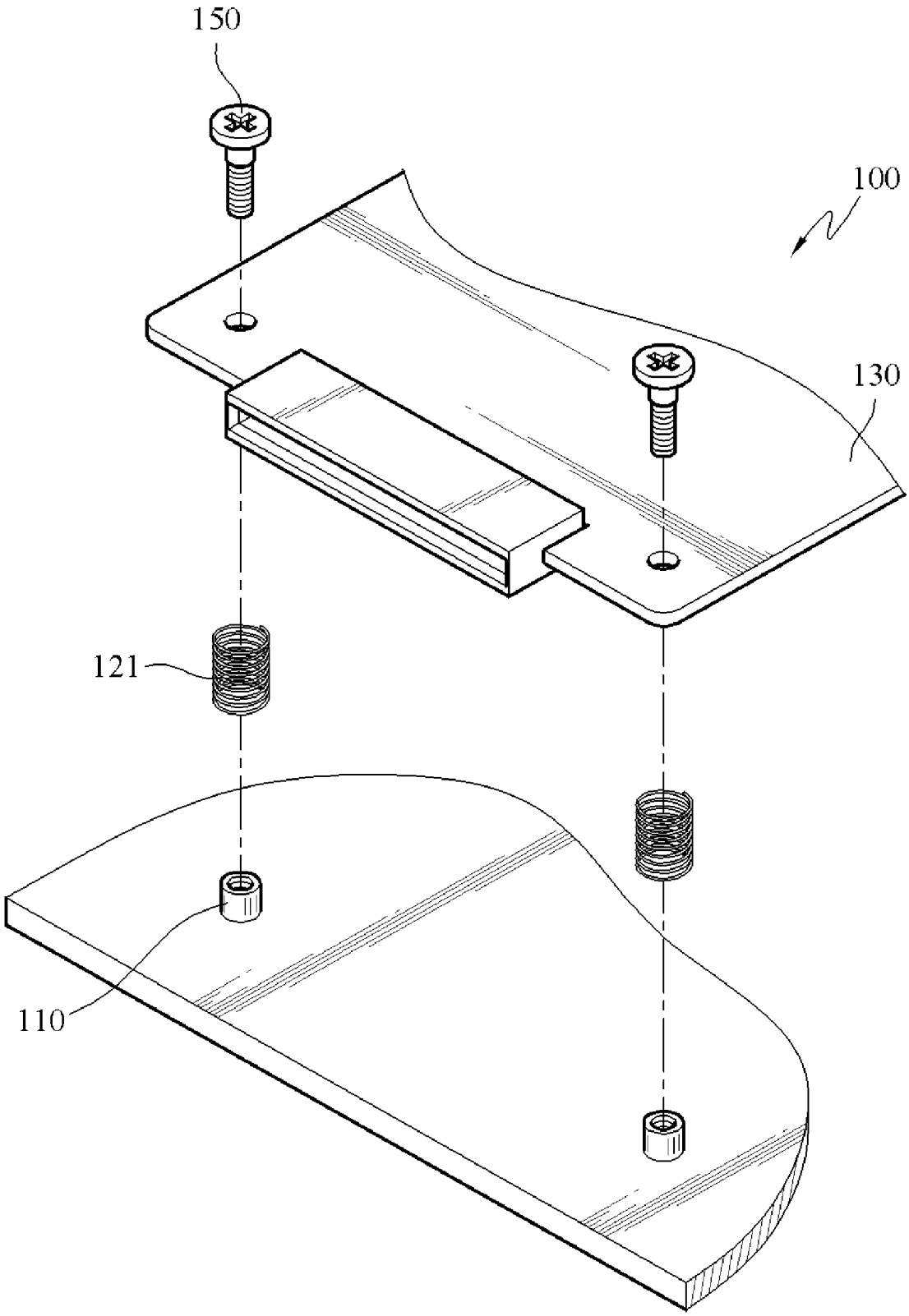
FIG. 3A is an exploded schematic view of a third embodiment of the present invention.
Figure 3B:
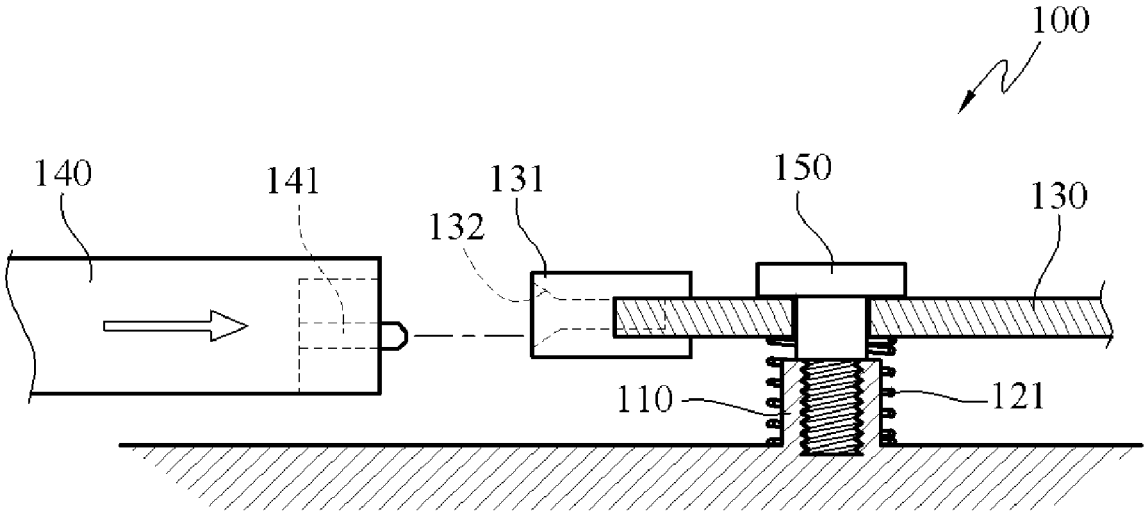
FIG. 3B is a schematic plan view of two elements not being connected according to the third embodiment of the present invention.
Figure 3C:
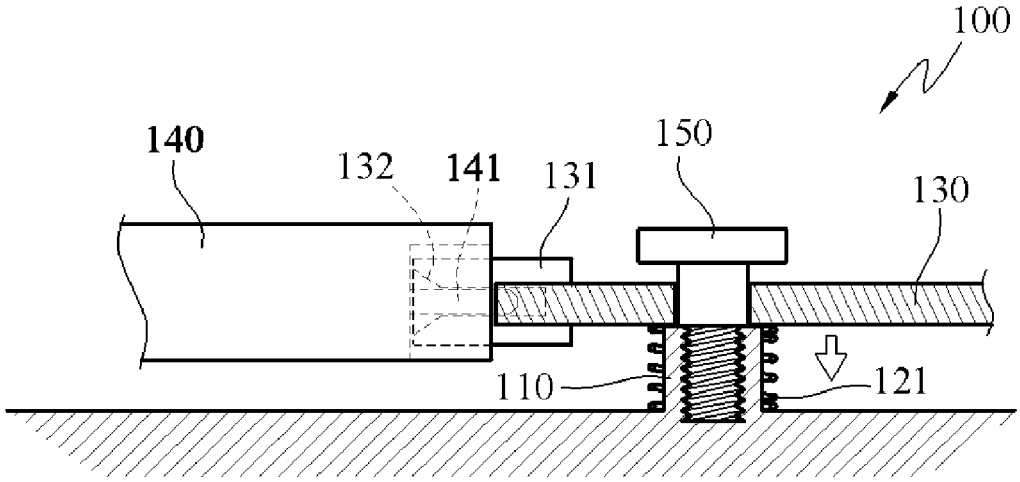
FIG. 3C is a schematic plan view of the two elements connected together according to the third embodiment of the present invention.
Figure 3D:
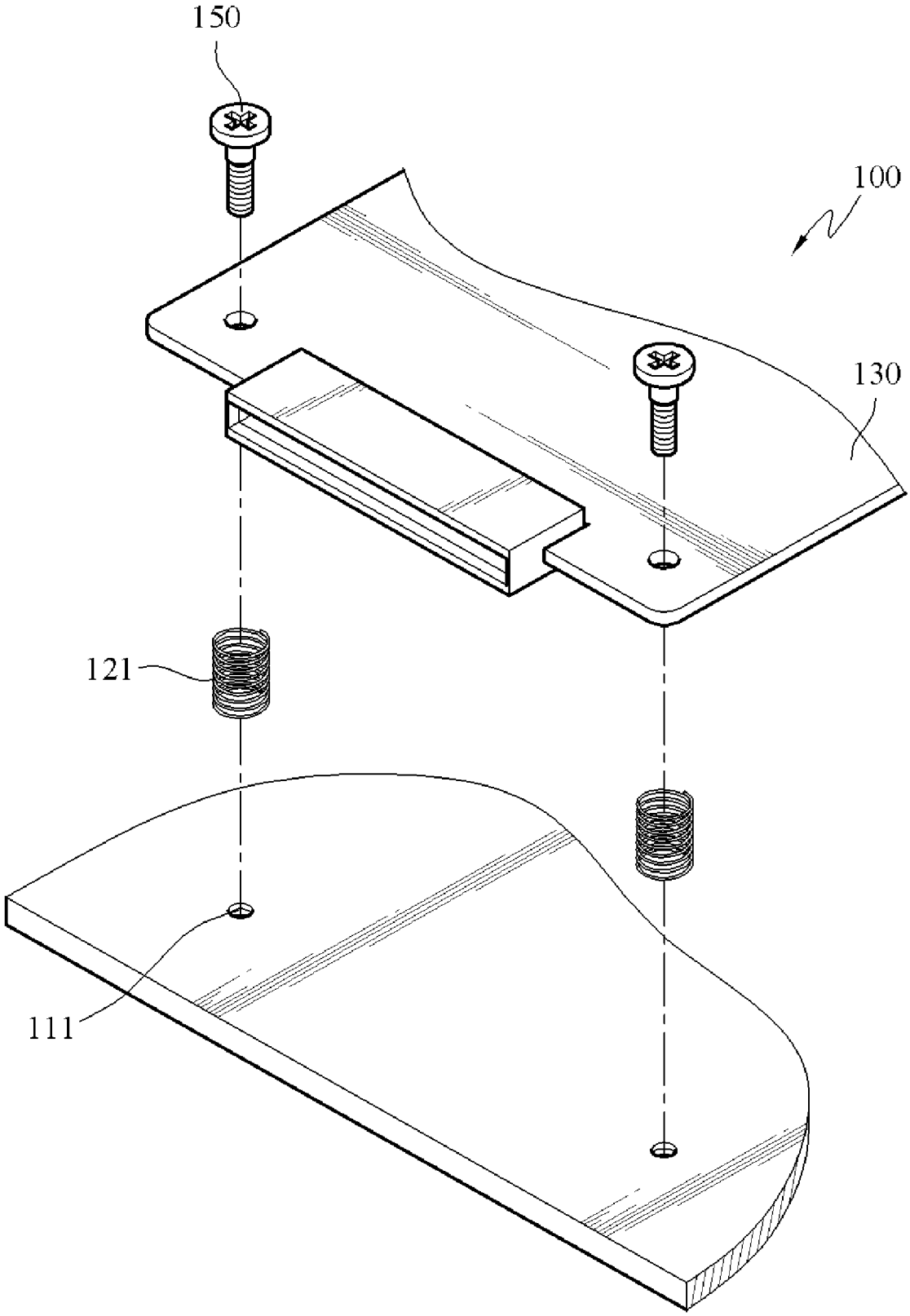
FIG. 3D is an exploded schematic view of a fourth embodiment of the present invention.
Figure 3E:
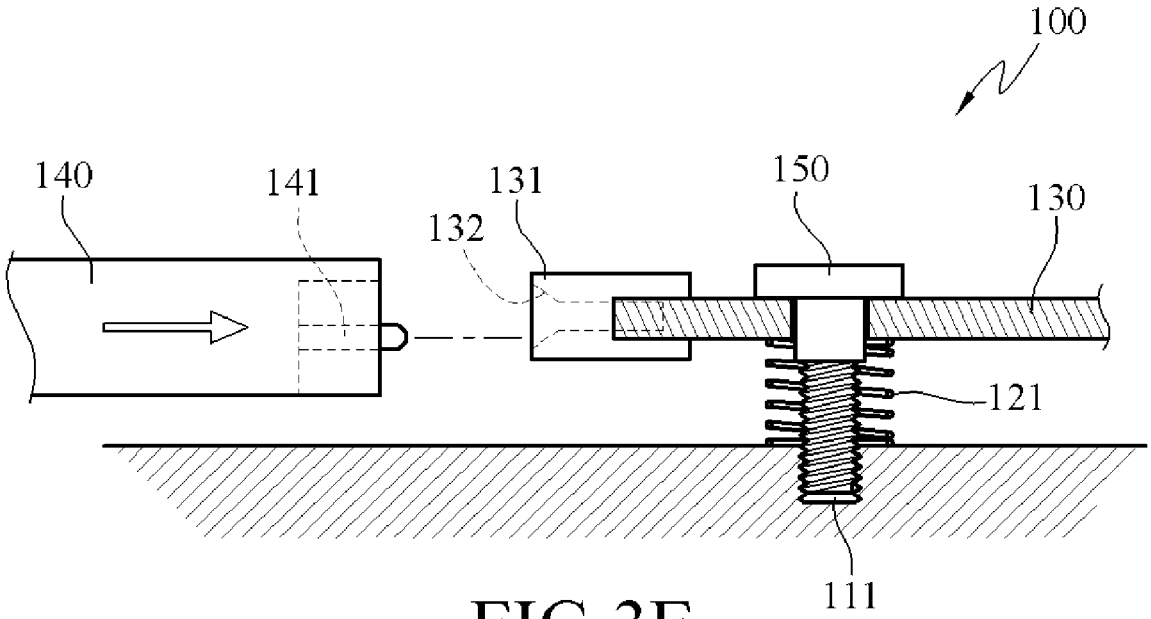
FIG. 3E is a schematic plan view of two elements not being connected according to the fourth embodiment of the present invention.
Figure 3F:
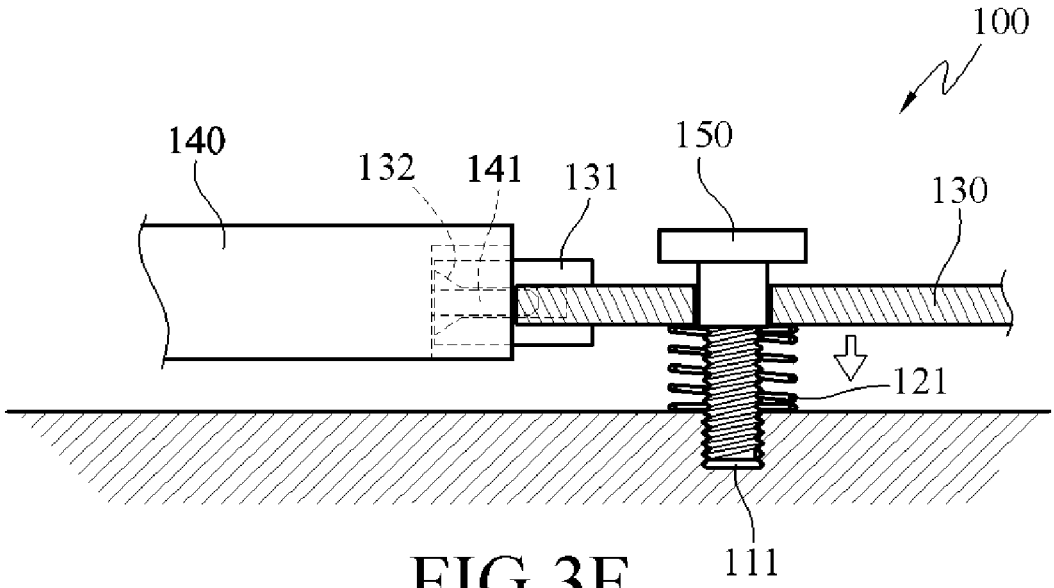
FIG. 3F is a schematic plan view of the two elements connected together according to the fourth embodiment of the present invention.
Figure 4A:
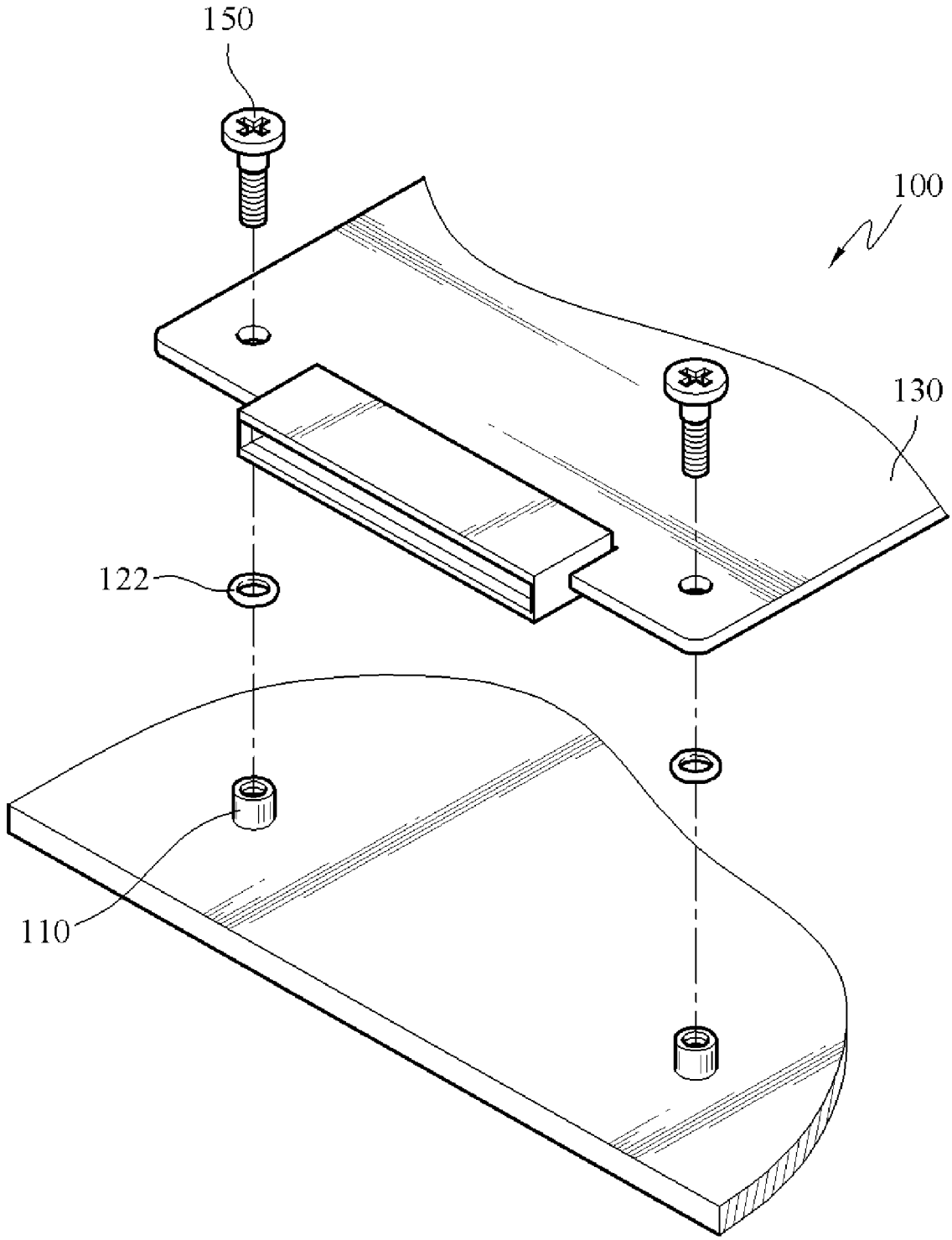
FIG. 4A is an exploded schematic view of a fifth embodiment of the present invention.
Figure 4B:
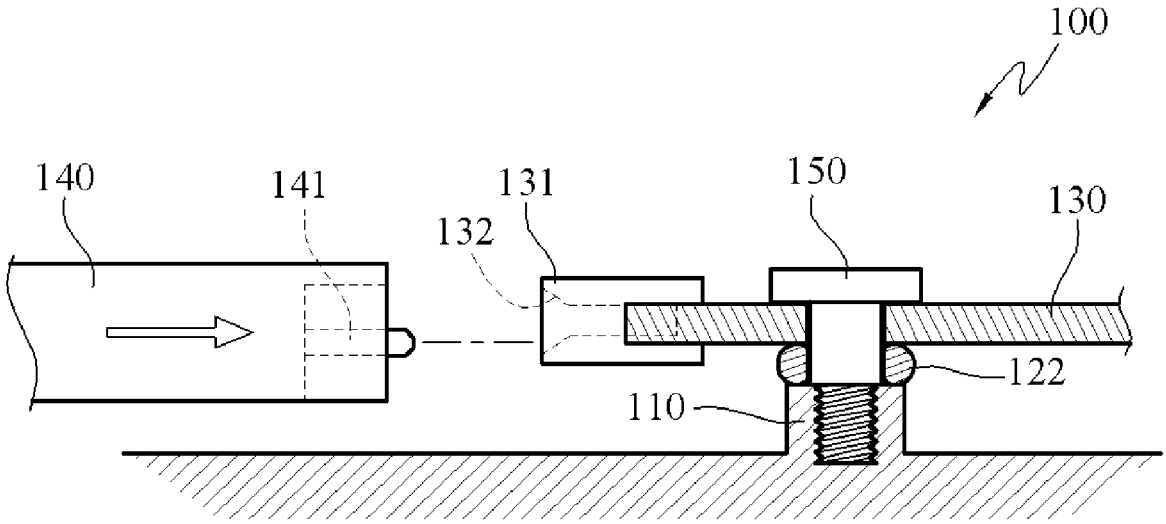
FIG. 4B is a schematic plan view of two elements not being connected according to the fifth embodiment of the present invention.
Figure 4C:
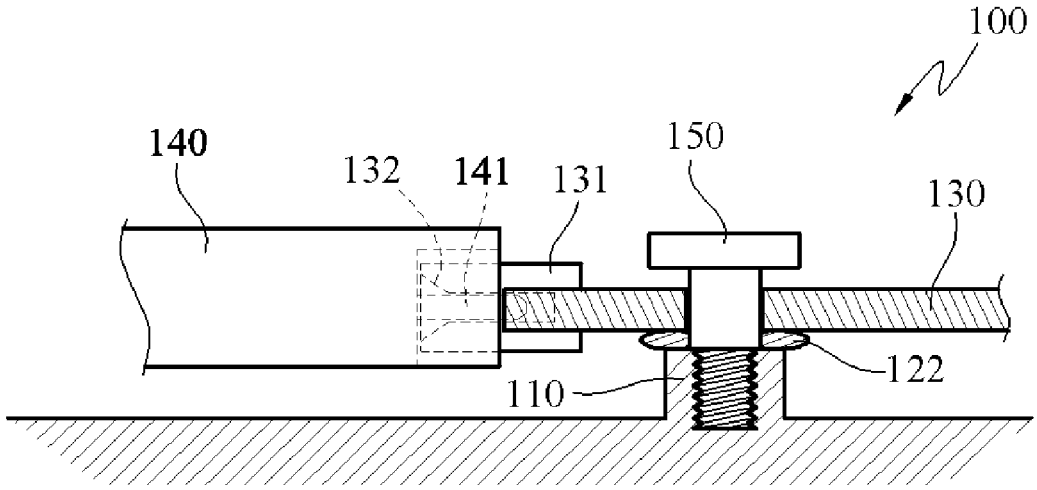
FIG. 4C is a schematic plan view of the two elements connected together according to the fifth embodiment of the present invention.
Figure 4D:
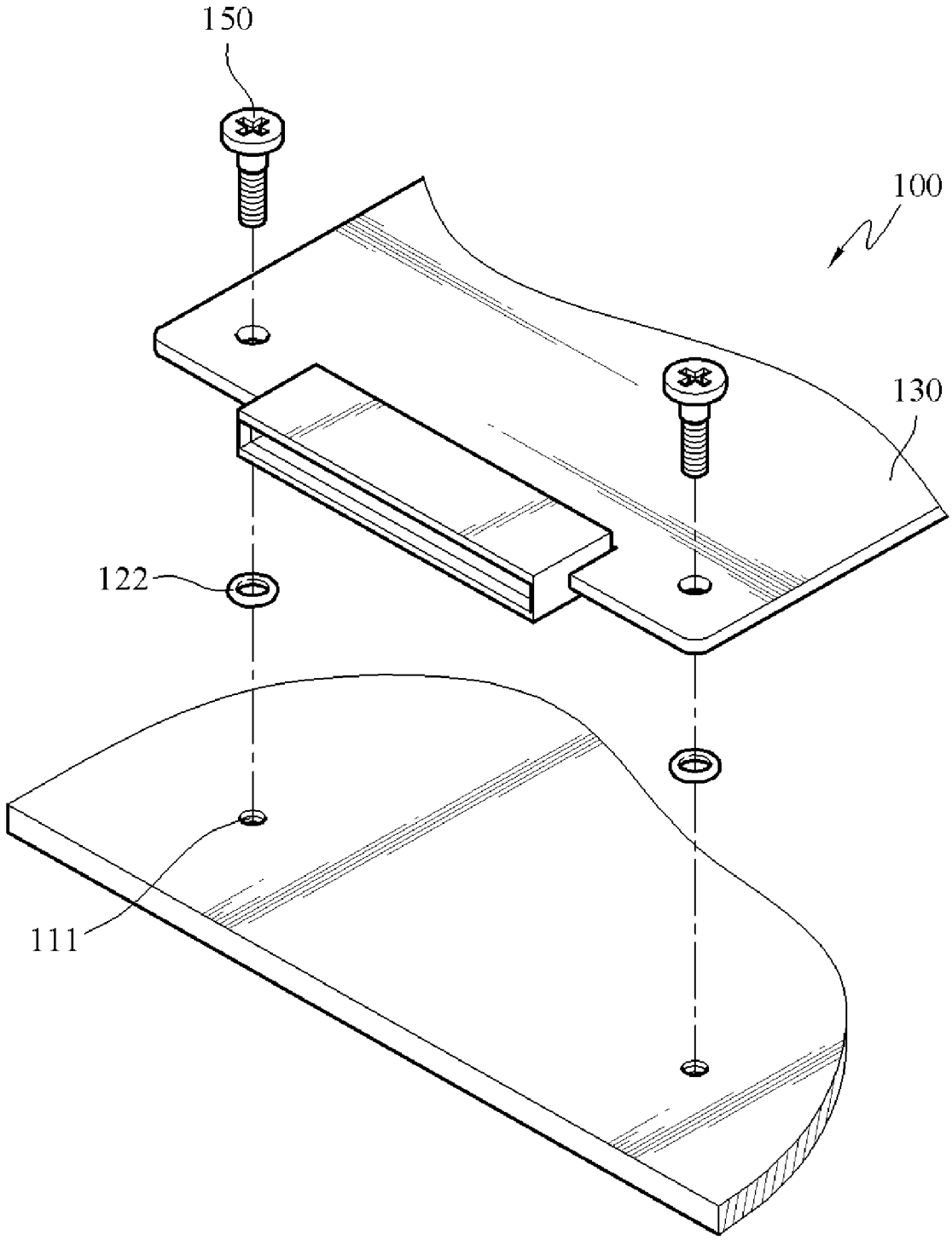
FIG. 4D is an exploded schematic view of a sixth embodiment of the present invention.
Figure 4E:
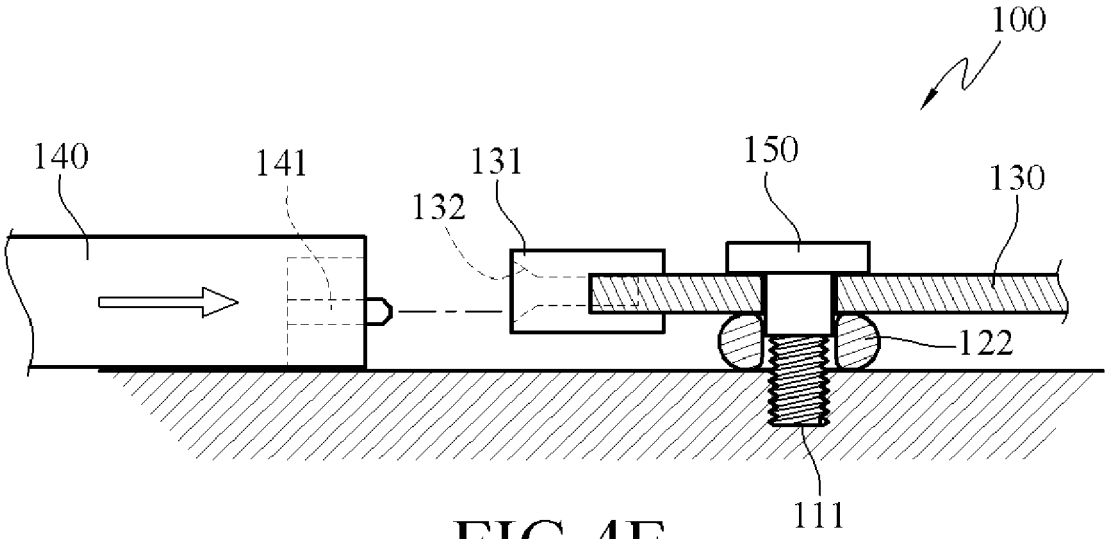
FIG. 4E is a schematic plan view of two elements not being connected according to the sixth embodiment of the present invention.
Figure 4F:
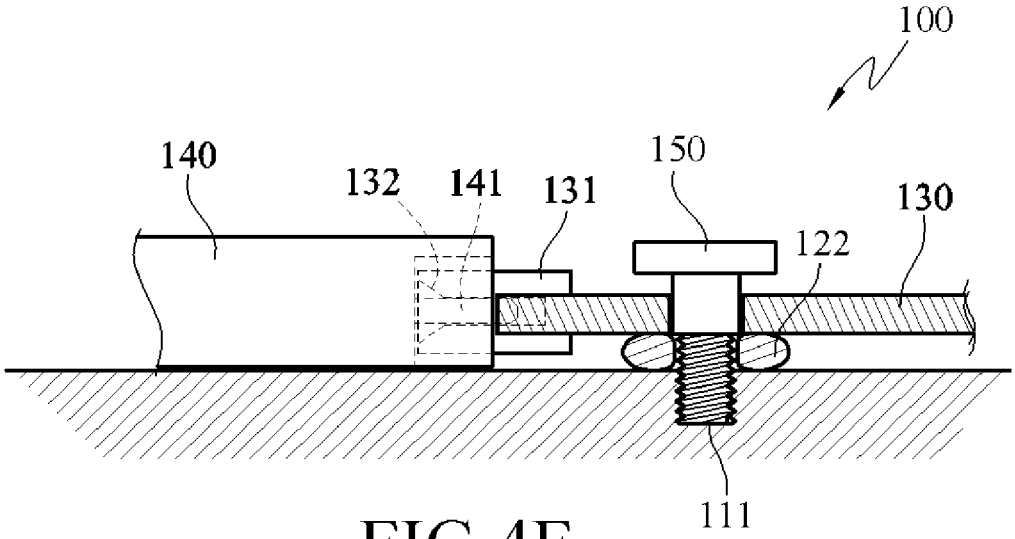
FIG. 4F is a schematic plan view of the two elements connected together according to the sixth embodiment of the present invention.

As shown in FIGS. 2D to 2F, a second embodiment of the present invention is shown, wherein the fixing part is a screw hole 111. When the bolt 150 passes through the motherboard 130 and combined with the screw hole 111, the motherboard 130 is pressed against the blade spring 120, wherein the maximum deformation of the blade spring 120 is the maximum elastic displacement range of the motherboard 130.

As shown in FIGS. 3A to 3F, the elastic member in a third embodiment and a fourth embodiment of the present invention is a spring 121 fitted on the pillar 110 or disposed on the screw hole 111, such that the motherboard 130 has an elastic displacement range, thereby achieving the object of adjusting the motherboard 130 and the removable hard disk drive 140 to be in the same height level and connected together.

As shown in FIGS. 4A to 4F, a fifth embodiment and a sixth embodiment of the present invention is shown. The elastic member as shown in the figures is a rubber washer 122 disposed between the fixing part and the motherboard 130, such that an elastic displacement range for the motherboard 130 can be obtained according to the deformation range of the rubber washer 122.

The efficacy of the present invention lies in that an elastic displacement of the first element can be obtained from the elastic deformation range of the elastic member, such that two elements not in the same height level can be connected together.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A computing device, comprising:

a case;

a motherboard disposed in the case, wherein the motherboard has a connector on one end;

an electronic device having an electrical connection end configured to be attachable to and detachable from the connector;

an elastic member disposed in the case and between the case and the motherboard, wherein the elastic member is configured move the motherboard with respect to the case so as to maintain a clearance between the case and the motherboard; and a bolt perforating the motherboard and the elastic member and fixed to the case;

wherein the elastic member comprises a substantially W-shaped blade spring with a through hole between two ends of the blade spring, the two ends of the blade spring being pressed by the motherboard, with the bolt perforating the blade spring through the though hole.

2. The computing device according to claim 1, wherein the case includes a pillar protruding from a surface of the case, the pillar perforates the blade spring through the through hole.

* * * * *